US005564259A

United States Patent [19]

Stolmeier

[11] Patent Number: 5,564,259

[45] Date of Patent: Oct. 15, 1996

[54] METHOD AND APPARATUS FOR RESEALABLE CLOSURE ADDITION TO FORM, FILL AND SEAL BAG

[75] Inventor: Robert C. Stolmeier, Shelbyville, Ind.

[73] Assignee: KCL Corporation, Shelbyville, Ind.

[21] Appl. No.: 270,327

[22] Filed: Jul. 5, 1994

Related U.S. Application Data

[63] Continuation of Ser. No. 135,323, Oct. 12, 1993, abandoned, which is a continuation of Ser. No. 887,337, May 22, 1992, abandoned.

[51] Int. Cl.[6] ..... B65B 9/00; B65B 43/04; B65B 61/18

[52] U.S. Cl. ..... 53/410; 53/412; 53/451; 53/455; 53/552; 53/562; 53/133.4; 493/214; 493/381

[58] Field of Search ..... 53/133.4, 139.2, 53/410, 412, 451, 455, 552, 562; 156/66; 493/214, 381; 383/5, 61, 63

[56] References Cited

U.S. PATENT DOCUMENTS

| | | | |
|---|---|---|---|
| 3,340,679 | 9/1967 | Johnson | 53/562 X |
| 3,532,571 | 10/1970 | Ausnit | 493/214 X |
| 4,355,494 | 10/1982 | Tilman . | |
| 4,601,694 | 7/1986 | Ausnit . | |
| 4,617,683 | 10/1986 | Christoff | 53/139.2 X |
| 4,617,785 | 10/1986 | Chikatani et al. | 53/562 |
| 4,691,373 | 9/1987 | Ausnit | 156/66 X |
| 4,709,533 | 12/1987 | Ausnit . | |
| 4,750,313 | 6/1988 | Kammler et al. | 53/451 |
| 4,812,074 | 3/1989 | Ausnit et al. . | |
| 4,909,017 | 3/1990 | McMahon et al. . | |
| 4,949,527 | 8/1990 | Boeckmann et al. | 53/412 |
| 5,024,537 | 6/1991 | Tilman | 383/63 |
| 5,036,643 | 8/1991 | Bodolay | 156/66 X |
| 5,046,300 | 9/1991 | Custer et al. | 53/139.2 X |
| 5,063,639 | 11/1991 | Boeckmann et al. | 156/66 X |

*Primary Examiner*—Linda Johnson
*Attorney, Agent, or Firm*—Woodard, Emhardt, Naughton Moriarty & McNett

[57] ABSTRACT

A method and apparatus for forming a resealable tubular form fill package is provided. A supply of thin thermoplastic film is continuously fed over a filling spout and formed into a tubular shape by bringing the lateral edges of the film together in an abutting face-to-face relationship. The faces of the edges are brought together at a seal location to form a fin seal. A supply of zipper closure is continuously fed adjacent the film material and adhered to the film. The film and the zipper closure are sealed and cut to produce a form fill package having a zipper closure. The zipper closure and film may be cut and sealed simultaneously.

14 Claims, 7 Drawing Sheets

METHOD AND APPARATUS FOR RESEALABLE CLOSURE ADDITION TO FORM, FILL AND SEAL BAG

CROSS-REFERENCE TO RELATED APPLICATION

This application is a file wrapper continuation of application Ser. No. 08/135,323, filed Oct. 12, 1993 and now abandoned, which is a file wrapper continuation of application Ser. No. 07/887,337, filed May 22, 1992 and now abandoned.

BACKGROUND OF THE INVENTION

This invention relates to providing conventionally manufactured bags with a resealing mechanism and to reclosable bags in general. In particular, this invention relates to a method and apparatus for attaching a resealable closure to a bag in a form, fill, and seal process.

There are presently a multitude of products on the market whose usable life is dependent upon protection from exposure to air. These products include cereals, snack chips, candies, coffee, and the like. Because these products generate a widespread demand for airtight containers, numerous seals, packages, and package manufacturing methods have been provided. Many of these prior packages employ interlocking profile fasteners as a means of allowing resealable access to an airtight container.

U.S. Pat. Nos. 4,812,074 and 4,601,694 disclose material and apparatus for making bags having reclosable zipper profiles. In these devices, the zipper is fully integrated into the bag and is a part of the bag's primary sealing mechanism. The patents also disclose the application of an interlocking profile fastener to the bag in a direction parallel to the direction that the bag web material travels during the manufacturing process.

U.S. Pat. No. 4,909,017, et al. discloses a method of making a form fill bag having a reclosable fastener thereon. During the manufacturing process reclosable fasteners are attached to the bag in a direction perpendicular to the flow of the web material.

Reclosable plastic zippers have also been applied to bags during the form, fill, and seal process in a direction parallel with the travel of the web material of the bag. U.S. Pat. No. 4,709,533 discloses a method and apparatus for forming a vertical tubular form fill package. A plastic zipper and a thin seal form the spine of the bag. A similar method and apparatus is disclosed in U.S. Pat. No. 4,355,494 where the two sides of the interlocking profile fastener are applied to the bag independently in a direction parallel with the flow of the web material and are pressed and sealed together as the bag travels over the form, fill, and seal apparatus.

The aforementioned methods and apparatus suffer from a number of drawbacks. In those methods and devices that utilize an interlocking profile fastener as the sole sealing means for the package, a considerable amount of leakage can occur during the period of time when the product is being shipped and placed on the shelves in stores. Likewise, in those devices that utilize the combination of an interlocking profile fastener and an outer pilfer protection seal there is a higher likelihood of failure of the airtight seal of the bag than there is for a bag manufactured in a conventional form, fill, and seal process. Furthermore, devices that do not provide any type of pilfer protection may be tampered with at any point prior to the sale of the product.

A further drawback of the existing methods of applying resealable closures is the fact that most manufacturing plants that presently utilize a conventional form, fill, and seal apparatus would need to purchase new equipment or retool their own equipment to add an interlocking profile fastener seal to the form, fill, and seal bag. The degree of retooling to accomplish this type of change may be considerable. It would be advantageous, therefore, to provide a means of attaching interlocking profile fasteners to packages as a part of the conventional form, fill, and seal process in a way that requires a minimum of retooling.

There have also been many inventions relating to manufacture of resealable closure mechanisms for application to existing packages. These inventions include a zipper closure with unitary adhesive cover sheet for selective attachment along an elongated opening in a preexisting container. The closure can be purchased by a consumer and applied to a package after a slit has been cut in the package. Likewise, a tape carried precut zipper for attachment to the mouth end of a bag has also been proposed.

The present invention employs a resealable closure that can be applied at any location on an existing bag. The present invention also contemplates a method and apparatus for the application of a precut zipper that can be readily integrated into a method and apparatus of producing form, fill, and seal bags.

SUMMARY OF THE INVENTION

In one embodiment of the present invention, an apparatus and a method are provided for manufacturing resealable form fill packages. The present invention provides for continuously feeding a supply of thin thermoplastic film from a supply means over a filling spout to form a tubular shape. The edges of the film are brought together at a seal location to form a fin seal. A continuous supply of zipper closure member material is fed adjacent the thin film from a supply means. The zipper closure member material has two sides, a pair of reclosable profiles mounted on the sides, and, in one embodiment, an adhesive means disposed on one side of the member for attachment of the member to the film. The zipper closure member and the film are also sealed and cut to produce a resealable form fill package.

The zipper closure member material may be applied in a direction either parallel with or perpendicular to the feeding direction of the film. Furthermore, the zipper closure member material and the film material may be cut and sealed simultaneously by a set of sealing and cutting bars.

Still another embodiment of the invention might include a method and apparatus for horizontally producing a resealable form fill package from a sheet of plastic film. In this embodiment of the invention, plastic film is continuously fed from a supply means. The plastic film is wrapped into a U-shape to bring the sides of the film together in an abutting face-to-face relationship. A continuous supply of zipper closure member material is fed adjacent the thin film. The zipper closure member material has two sides and a pair of reclosable profiles mounted on the sides that are adapted to reclosably close the sides together. The zipper closure member material also has adhesive means disposed on one side for attachment of the closure member material to the film. The zipper closure member material and the film are sealed and cut to produce a form fill pouch. The pouch is filled with some type of product and then sealed.

The sealing and cutting of the film in zipper closure material may be performed simultaneously by a set of sealing and cutting bars in this embodiment of the invention. Furthermore, the zipper closure member material may be adhered to the form fill package after the package is sealed.

It is accordingly one object of the present invention to provide an improved resealable form, fill, and seal package.

Another object of the invention is to provide a resealable form, fill, and seal package that is low in cost, reliable, and can be manufactured without drastically altering present methods and machinery used to make form, fill, and seal packages.

Related objects and advantages of the present invention will be apparent from the following description.

DESCRIPTION OF THE PREFERRED EMBODIMENTS

Figure 1:
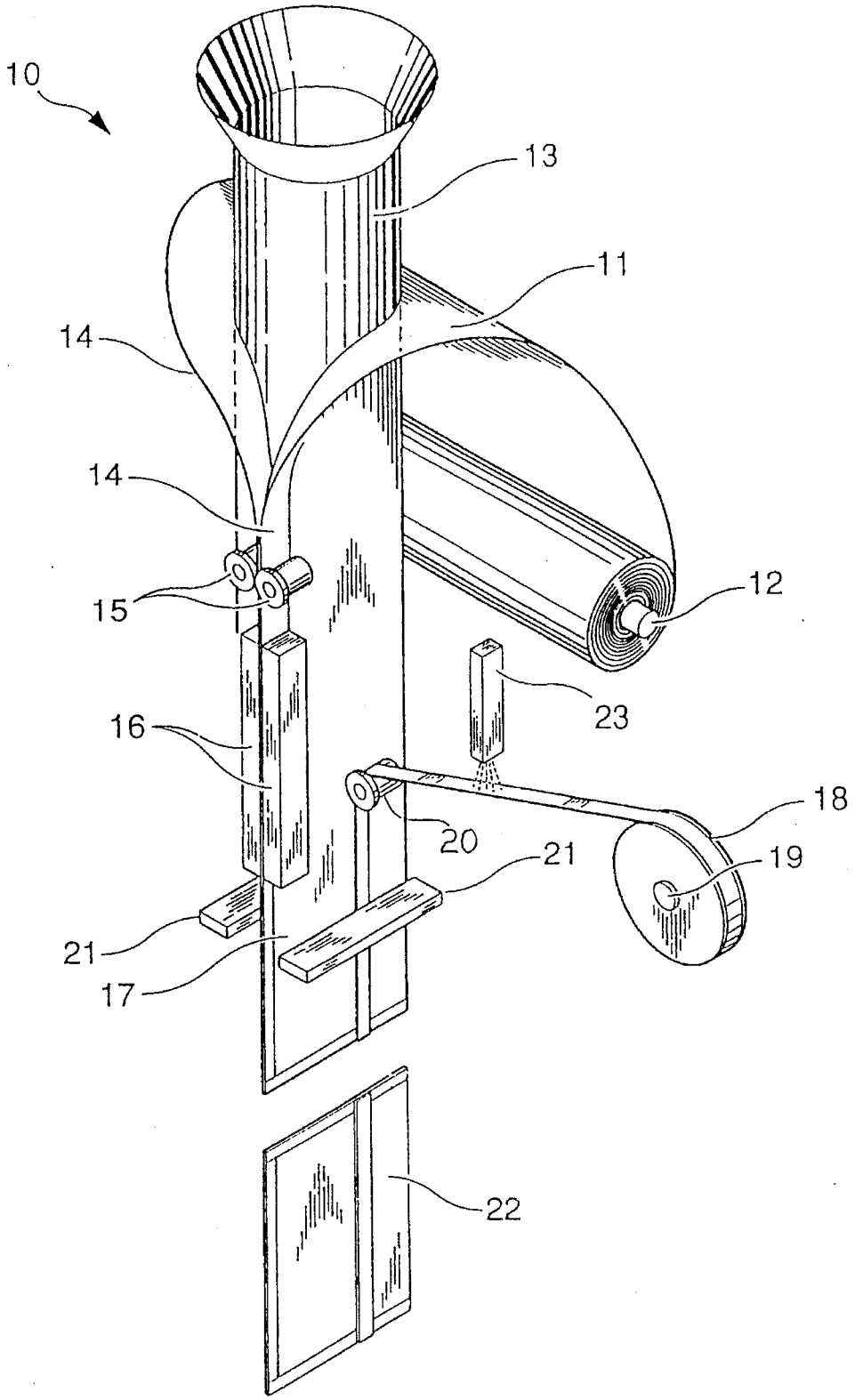
FIG. 1 is a perspective view of the preferred embodiment of the present invention as used in a vertical form, fill, and seal process.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1 there is shown an apparatus 10 for a vertical form, fill, and seal process which incorporates the present invention. A supply of thin thermoplastic film 11 is shown disposed about film dispensing spool 12. The procedure for manufacturing the form, fill, and seal packages begins with the film 11 being wrapped into a tubular shape over a filling spout 13. Lateral edges 14 of the film 11 are brought together in an abutting face-to-face relationship by fin rollers 15. The faces of lateral edges 14 are next pressed roger:her by fin sealing bars 16. The result is the formation of a tube 17 of thermoplastic film 11. This portion of the present invention can be accomplished by using a number of commercially available form, fill, and seal machines such as those manufactured by Hayssen Company.

A continuous supply of zipper closure member 18 is shown disposed about a closure dispensing spool 19. Zipper closure members 18 are payed off spool 19 and drawn toward the film tube 17 by a roller 20. Adhesive is sprayed onto the zipper closure members 18 by adhesive applicator 23. Roller 20 then presses the zipper closure members firmly onto the side of film tube 17. After the zipper closure members 18 are applied to the film tube 17, sealing and cutting bars 21 simultaneously cut and seal the film tube 17, and the zipper closure member 18 to produce a form filled package 22.

Figure 5:
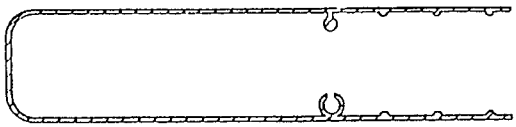
FIG. 5 is a sectional view of a zipper closure bag that is applied to form, fill, and seal pakages as a part of the present invention.
Figure 6:
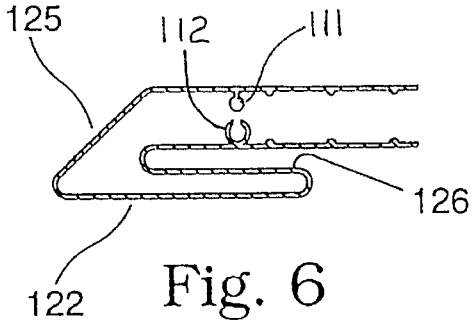
FIG. 6 is a sectional view of the bag of FIG. 5 showing it folded into a new configuration.
Figure 8:
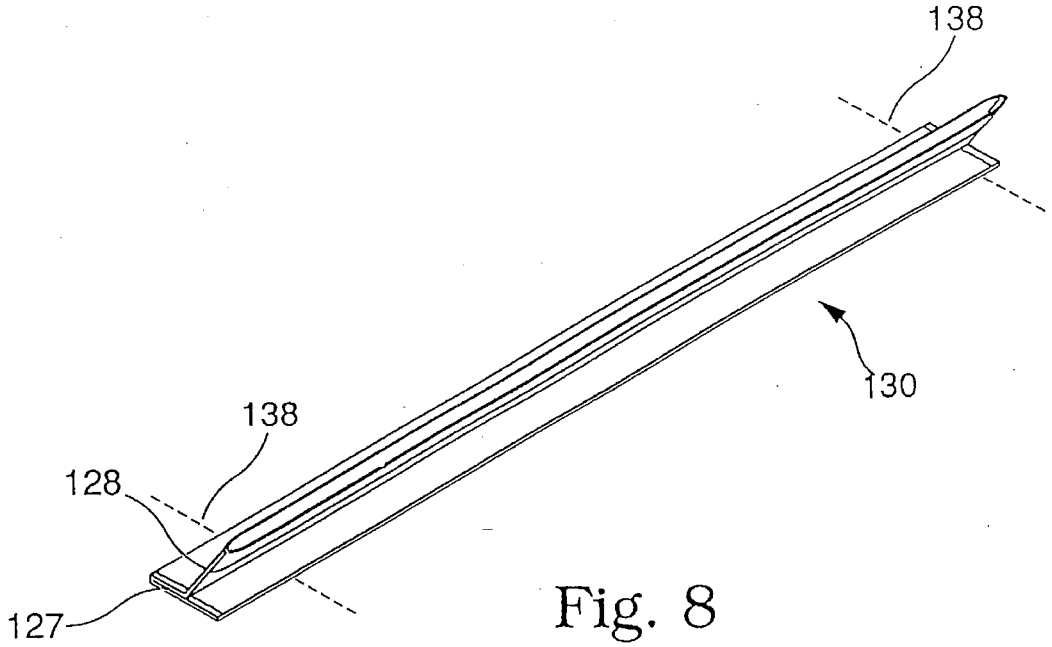
FIG. 8 is a perspective view of the zipper closure bag showing particularly the end thereof.

A typical zipper closure member is shown in section in FIG. 5. The zipper closure members can be folded as shown in FIG. 6 to provide a bottom surface 122. It will be noted that the member of FIG. 6 has sides 125 and 126. The sides 125 and 126 and the bottom 122 are all sealed together at the ends 127 of the sides and bottom as shown in FIG. 8. Such sealing is accomplished in conventional manner by heat and may require a spot seal at 128 where the profiles provide relatively greater thickness than the rest of the flexible plastic material. The sealing of the zipper closure members at ends 127 may also be accomplished by sealing and cutting bars 21 shown in FIG. 1. Both the end of the form, fill and seal package and the zipper closure member are sealed and separated by the sealing and cutting bars 21.

The material of which members 18 are made may be what is known as "low density" polyethylene and may have a thickness of approximately two mills (0.002"). Other flexible plastic materials, however, may be used if desired.

Figure 7:
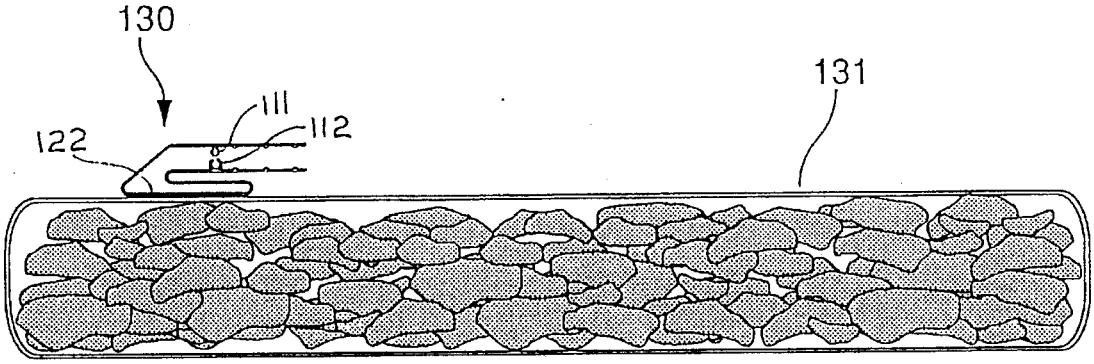
FIG. 7 is a sectional view showing the bag of FIG. 6 adhered to a form, fill, and seal package providing reclosability for the package.

Referring to FIGS. 6 and 7, the member 130 resulting from the folding and sealing can be adhered at its bottom 122 to a form, fill, and seal package 131. The bottom 122 of the member and the form, fill, and seal package 131 can be cut to provide access to the package. Such cutting is accomplished within the adhered portion of the bottom 122 so that closure of the profiles 111 and 112 together seals the package 131. (That is cutting of the package 131 and member bottom 122 is accomplished between the dotted lines 138 of FIG. 8.). The member 130 may be attached to the package 131 by heat sealing or by adhesive sprayed on the zipper closure members 18 by spray applicator 23.

Figure 9:
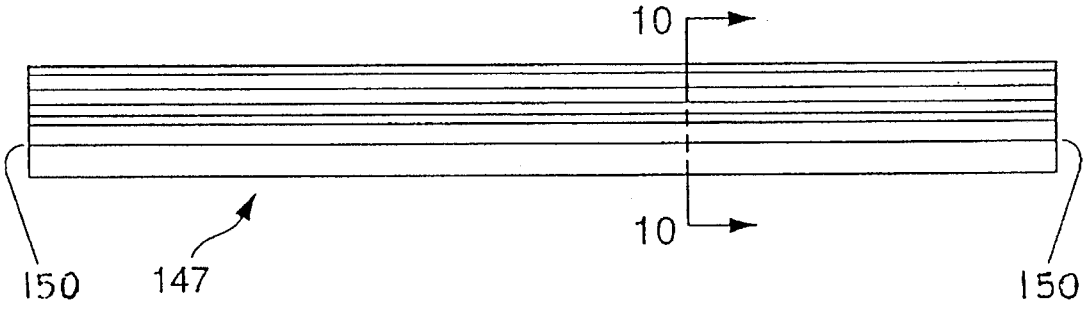
FIG. 9 is a side elevation of an alternative embodiment of a zipper closure bag.
Figure 10:
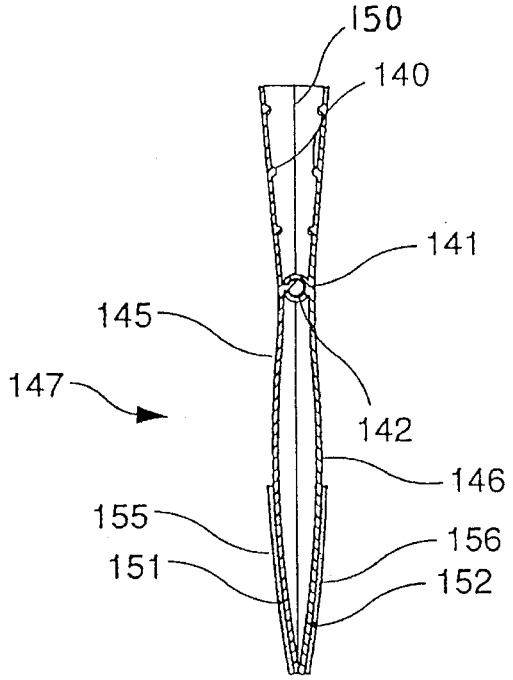
FIG. 10 is an enlarged section taken along the lines 10—10 of FIG. 9 showing the cross-sectional configuration of the closure of FIG. 9.

FIG. 9 is a side elevation of an alternative embodiment of the member. The embodiment illustrated in FIG. 9 includes ribs 140 (see FIG. 10) and profiles 141 and 142. The sides 145 and 146 of the member 147 are sealed together at 150 and the member has adhesive application areas 155 and 156 on the lower portions 151 and 152, respectively, of the sides 145 and 146.

Figure 11:
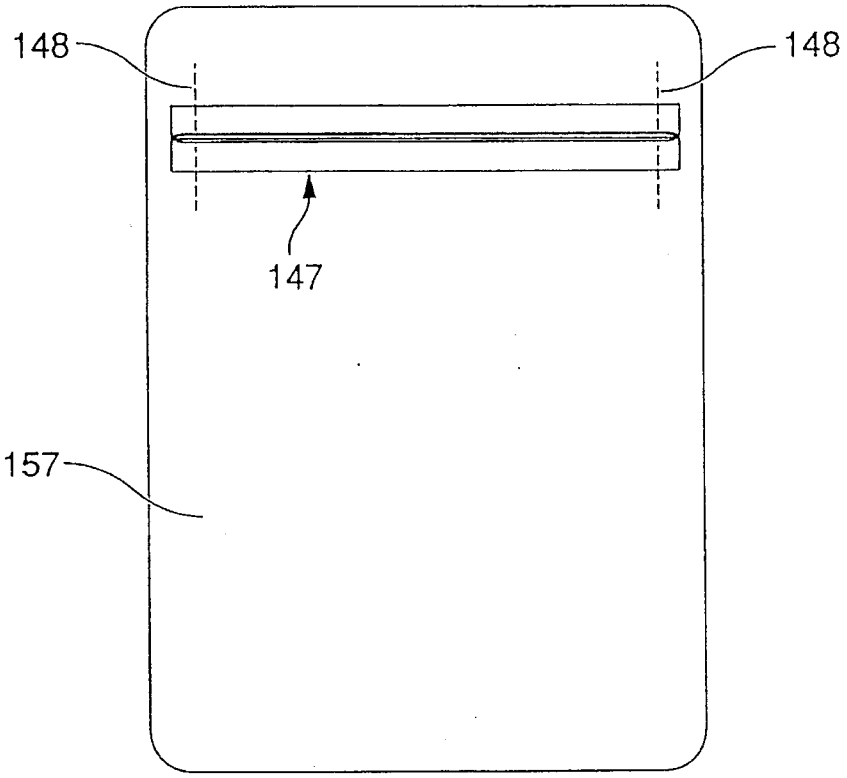
FIG. 11 is a side elevation of a package showing the zipper closure bag of FIGS. 9 and 10 mounted thereon.

FIG. 11 shows the member 147 after it has been attached to a form, fill, and seal package 157. Such attachment can be accomplished at any location on the container that has a sufficient length to attach the adhesive application areas 155 and 156. A cut can be made in the side of the package through the adhered portion of the member 147 so that access is provided into the form, fill, and seal bag 157. The cut extends between the dotted lines 148 so as to be within the adhered portion of the member. As shown in FIG. 11, the member 147 has its profiles 141 and 142 closed together so that closure has been accomplished. It has been found that coloring of the adhesive is particularly effective in identifying where the cut can be made to keep it within the area of the adhesive.

Figure 2:
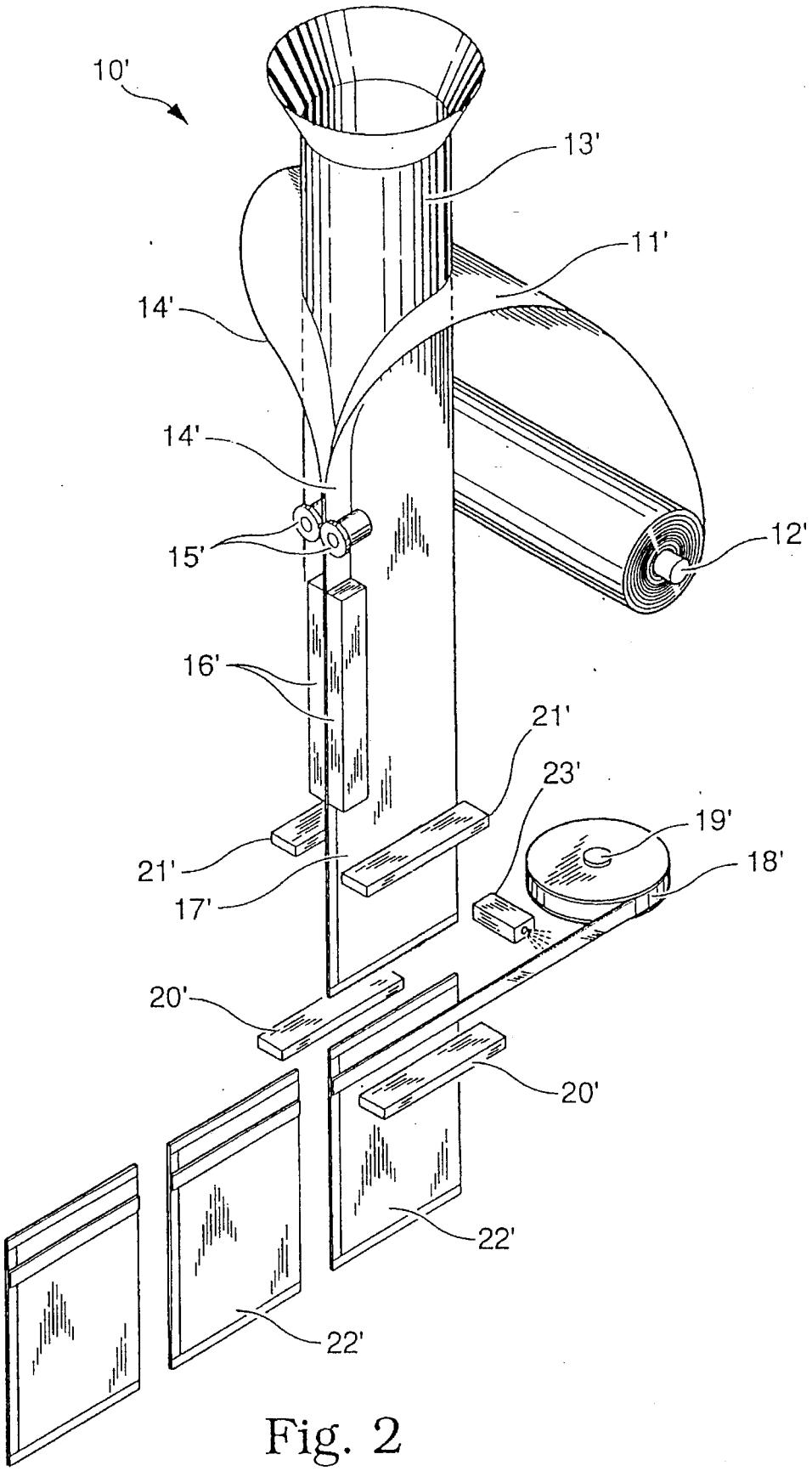
FIG. 2 is a perspective view of an alternative embodiment of the present invention as used in a vertical form, fill, and seal process.

An alternative embodiment of the invention, as applied to the vertical form, fill, and seal process, is shown in FIG. 2. The alternative embodiment has many of the same features of the previously described embodiment. Like elements are given a prime (') designation, such as film 11' which is film 11 in FIG. 1.

In the alternative embodiment of the invention, zipper closure members 18' are applied to finished form filled package 22' after the package 22' has been separated from film tube 17' by sealing and cutting bars 21'. It should be noted that zipper closure members 18' may be spooled out continuously and cut immediately prior to application to the form fill package 22' or the zipper closure members 18' may consist of individually precut zipper closure members that are applied to the packages 22'. In this embodiment, sealing bars 20' act as a counterpart to roller 20 of FIG. 1. In other words, sealing bars 20' act as the means for securing the zipper closure member 18' to the outer surface of package 22'.

Figure 3:
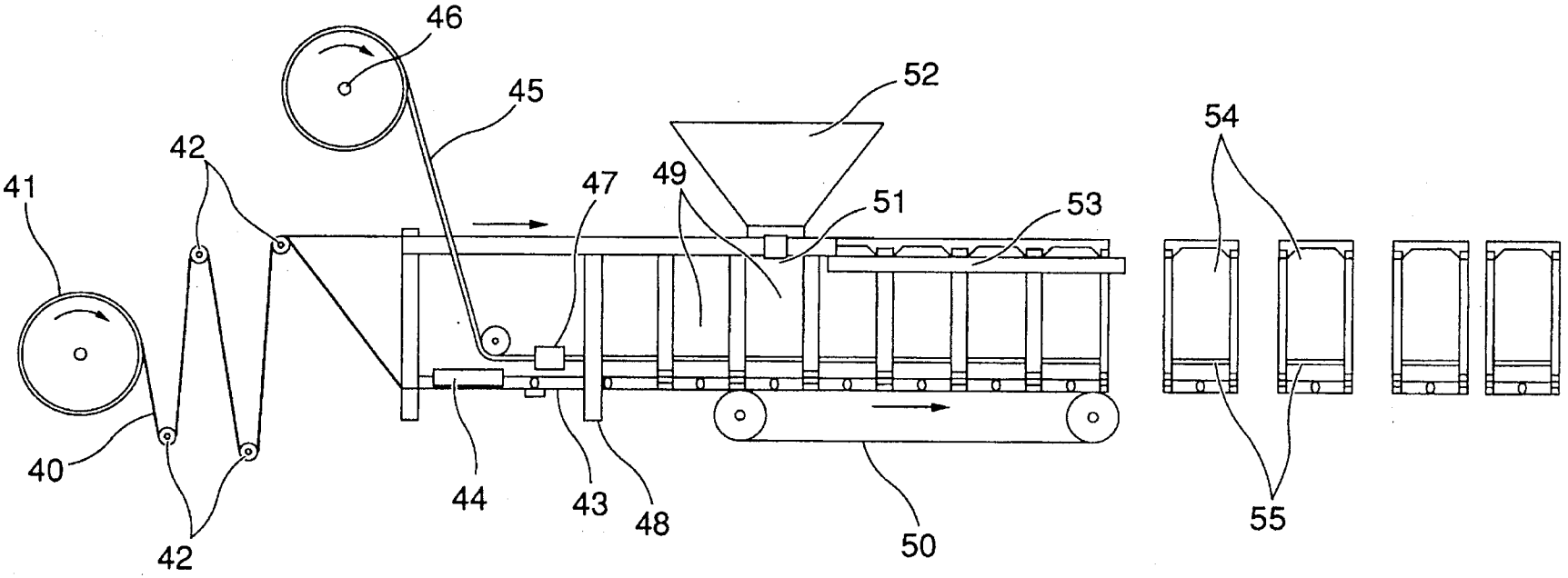
FIG. 3 is a elevational view of the preferred embodiment of the present invention as used in a horizontal form, fill, and seal process.

FIG. 3 illustrates one embodiment of the present invention for use in a horizontal form, fill and seal process. In this embodiment of the invention, thermoplastic film 40 is dispensed from pouch web supply roll 41 past a series of tensioning rollers 42. The film then proceeds in a left to right direction and a fin seal 43 is created along the bottom edge of the thermoplastic film 40 by sealing bar 44. This portion of the present invention can be accomplished by using a number of commercially available form, fill, and seal machines.

Shown above the form, fill, and seal assembly line is a supply of zipper closure members 45. In this embodiment of the invention, zipper closure members 45 are payed out from a dispensing roll 46. Zipper closure members 45 are then sprayed with adhesive and pressed onto thermoplastic film 40 by a roller 47. The thermoplastic film 40 and the zipper closure members 45 are simultaneously cut and sealed by cut and seal bar 48.

Next, empty pouches 49 are transported by conveyor 50 to a filling location 51. A filling spout 52, disposed above empty pouches 49, provides a means of filling the pouches. The top portion of the pouches 49 are finally sealed by an upper sealing bar 53. The result of this process is a form, fill, and seal package 54 having a resealable closure member 55 attached thereto.

Figure 4:
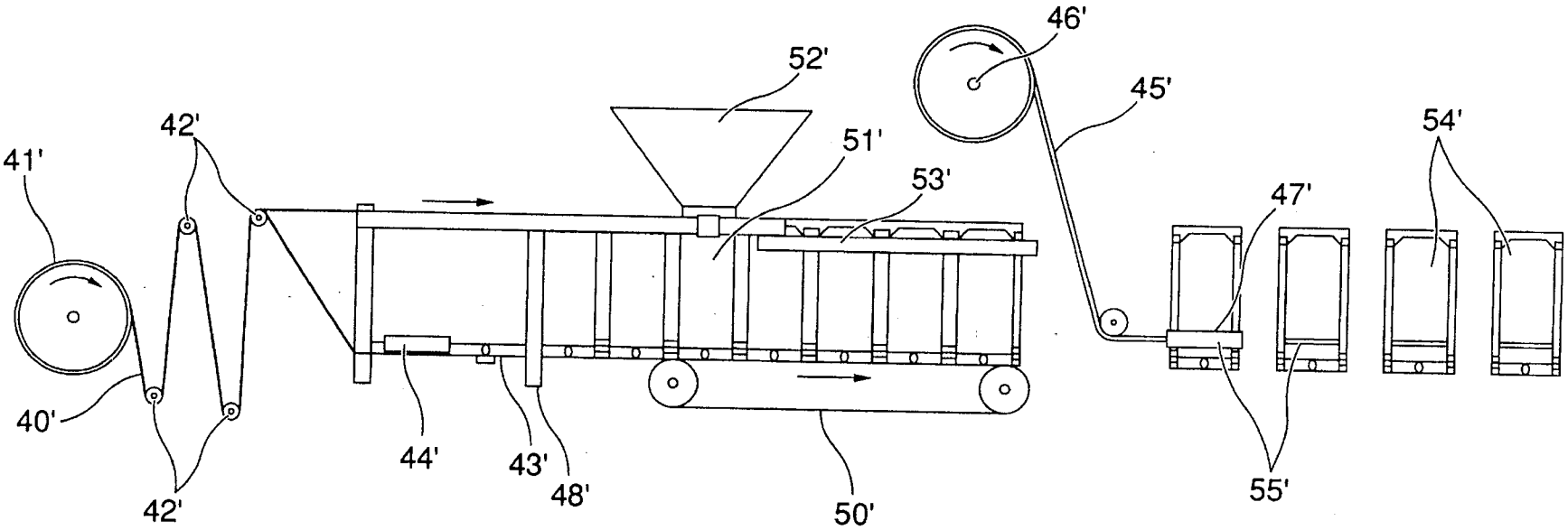
FIG. 4 is a elevational view of an alternative embodiment of the present invention as used in a horizontal form, fill, and seal process.

FIG. 4 also depicts a horizontal form, fill, and seal process. This alternative embodiment has many of the same features of the previously described embodiment. Like elements are given a prime (') designation, such as film 40' which is film 40 in FIG. 3.

In this embodiment, resealable closure members 55' are applied to form, fill, and seal packages 54' after the packages pass the upper sealing bar 53'. It should be noted that resealable zipper closure members 45' may be a continuous strip that is cut and sealed immediately prior to application on the package 54' or zipper closure members 45' may be discreet closures arranged in a perforated line that could be cut and applied to the packages individually.

One of the features that might be provided with the zipper closure members is coloring of the surface of the package 131 or 157 so that the user knows where to cut the opening. Thus a target area is located for the consumer. There are presently marketed bags such as, for example potato chip bags, which have on them a line which says "cut here". The bag also has a foil-type top which is intended to be coiled or rolled in order to close the bag and to keep the potato chips fresh. This intended purpose for the foil does not always operate effectively because the foil tends to become uncoiled if it is not held in the coiled position by some positive means. It can be appreciated that such a bag and ocher existing bags can use the closure of the type shown herein merely by adhering the closure to the existing form, fill, and seal bag, thus providing reclosability.

There are a number of advantages of the present invention. One advantage is that in many cases the existing packaging procedures will not have to be substantially modified. A further advantage is the low cost of the present method and apparatus. Still another advantage is that machinery and processes that are used to manufacture the present packages need not be modified in order to provide reclosability. Still another advantage of the invention is that "leakers" that might be caused by adding reclosable features are not produced by the invention. The existing package remains and the package is made and sealed in the standard manner with the reclosable feature being added later. As indicated above, the ends of the zipper closure member 18 are sealed which results in the interior of the zipper closure member 18 being sealed (so long as the zipper is closed or sealed) which results in the form, fill, and seal package being resealable by the zipper being closed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of forming a vertical form fill package from a sheet of plastic film comprising the steps of:

(1) continuously feeding a supply of thin thermoplastic film from a supply means, said film having an inner surface and and outer surface;

(2) wrapping said film around a filling spout so that said inner surface of the said film faces said filling spout and said outer surface faces away from said spout, and bringing the lateral edges of said inner surface of said film together in an abutting face-to-face relationship;

(3) attaching the faces of said edges together at a seal location to form a fin seal;

(4) feeding a continuous supply of zipper closure member material adjacent said outer surface of said film as it is continuously fed from said supply means; said member having two sides, a pair of reclosable profiles mounted on said member material sides and being adapted to reclosably close said sides together, and further having adhesive disposed on one of said member material sides for attachment of said closure member material to said outer surface of said film;

(5) adhering said adhesive side of said zipper closure member material to said outer surface of said film apart from said fin seal; and (6) sealing and cutting said film and said zipper closure member material to produce a form fill package having a zipper closure member material adhered to the outer surface thereof, wherein said form fill package may be resealably opened and closed.

2. The method of claim 1 wherein step (1) includes feeding said film in a first direction, and step (4) includes feeding said zipper closure member material so that said reclosable profiles are parallel to said first direction.

3. The method of claim 2 wherein the sealing and cutting said film and zipper closure member material of step (6) is performed simultaneously by a set of sealing and cutting bars.

4. The method of claim 1 wherein step (1) includes feeding said film in a first direction, and step (4) includes feeding said zipper closure member material in a second direction so that said reclosable profiles are perpendicular to said first direction and further wherein said zipper closure member material includes two sealed ends.

5. An apparatus for forming a vertical form fill package from a sheet of plastic film comprising:

means for continuously feeding a supply of thermoplastic film, said film having an inner surface and an outer surface;

a supply spout for vertically dropping contents into the form fill package;

means for guiding and wrapping said supply of film about said spout as said film moves downwardly, said inner surface of said film facing said spout and said outer surface of said film facing away from said spout;

first means positioned relative to said spout for guiding the lateral edges of said inner surface of said film together in confronting relationship;

means for joining said lateral edges of said film to form a fin seal at a seal location;

means for feeding zipper closure member material adjacent said outer surface of said film as it is continuously fed from said supply means; said member material having two sides, a pair of reclosable profiles mounted on said member material sides and being adapted to reclosably close said sides together, and further having adhesive disposed on one of said member material sides for attachment of said zipper closure member material to said outer surface of said film;

means for adhering said adhesive side of said zipper closure member material to said outer surface of said film apart from said fin seal; and means for sealing and cutting said film and said zipper closure member material to produce a form fill package having a zipper closure member material adhered to the outer surface thereof, wherein said form fill package may be resealably opened and closed.

6. The apparatus of claim 5 wherein said means for feeding zipper closure member material is positioned to feed said zipper closure member material in a direction such that said reclosable profiles are parallel to said fin seal.

7. The apparatus of claim 6 wherein said means for sealing and cutting said film includes a set of sealing and cutting bars that seal and cut said film and said zipper closure member material simultaneously.

8. The apparatus of claim 5 wherein said means for feeding zipper closure member material is positioned to feed said zipper closure member material in a direction such that said reclosable profiles are perpendicular to said fin seal and further wherein said zipper closure member material includes two sealed ends.

9. A method of forming a horizontal form fill package from a sheet of plastic film comprising the steps:

(1) continuously feeding a supply of thin thermoplastic film from a supply means, said film having an inner surface and an outer surface;

(2) wrapping said film into a u-shape and bringing the edges of said inner surface of said film together in an butting face-to-face relationship;

(3) feeding a continuous supply of zipper closure member material adjacent said outer surface of said film as it is continuously fed from said supply means; said member material having two sides, a pair of reclosable profiles mounted on said member material sides and being adapted to reclosably close said sides together, and further having adhesive disposed on one of said member material sides for attachment of said closure member material to said outer surface of said film;

(4) adhering said adhesive side of said zipper closure member material to said outer surface of said film;

(5) sealing and cutting said film to produce a form fill pouch having an open end separate from said zipper closure member material;

(6) sealing and cutting said zipper closure member material to produce said pair of reclosable sides attached said pouch;

(7) filling said form fill pouch through said open end; and (8) sealing said open end to produce a form fill package having a zipper closure member material adhered to the outer surface thereof, wherein said form fill package may be resealably opened and closed.

10. The method of claim 9 wherein steps (5) and (6) are performed simultaneously by a set of sealing and cutting bars.

11. The method of claim 9 wherein steps (4) and (6) are performed after sealing said open end.

12. An apparatus for forming a horizontal form fill package from a sheet of plastic film comprising:

means for continuously feeding a supply of thin thermoplastic film from a supply means, said film having an inner surface and an outer surface;

means for wrapping said film into a u-shape and bringing the edges of said inner surface of said film together in an abutting face-to-face relationship;

means for feeding a continuous supply of zipper closure member material adjacent said outer surface of said film as it is continuously fed from said supply means; said member material having two sides, a pair of reclosable profiles mounted on said member material sides and being adapted to reclosably close said sides together, and further having adhesive disposed on one of said member material sides for attachment of said closure member material to said outer surface of said film;

means for adhering said adhesive side of said zipper closure member material to said outer surface of said film;

means for sealing and cutting said film to produce a form fill pouch having an open end separate from said zipper closure member material;

means for sealing and cutting said zipper closure member material to produce said pair of reclosable profiles attached to said pouch;

means for filling said form fill pouch through said open end; and means for sealing said open end to produce a form fill package having a zipper closure member material adhered to the outer surface thereof, wherein said form fill package may be resealably opened and closed.

13. The apparatus of claim 12 wherein said means for sealing and cutting said film and said zipper closure member material is a single set of sealing and cutting bars.

14. The apparatus of claim 12 wherein said means for adhering said adhesive side of said zipper closure member material is positioned to adhere said adhesive side of said zipper closure member material to said outer surface of said film after said form fill package is produced.

* * * * *